United States Patent [19]

Schaerer

[11] Patent Number: 5,036,681

[45] Date of Patent: Aug. 6, 1991

[54] MAGNETIZED EAR PIECE

[75] Inventor: Emil A. Schaerer, Zurich, Switzerland

[73] Assignee: Haim Einhorn, Miami, Fla.

[21] Appl. No.: 546,729

[22] Filed: Jul. 2, 1990

[51] Int. Cl.[5] ..... A44C 7/00

[52] U.S. Cl. ..... 63/14.5; 63/29.2

[58] Field of Search ..... 63/15.5, 15.4, 15.3, 63/15.1, 29.2

[56] References Cited

U.S. PATENT DOCUMENTS

| | | | |
|---|---|---|---|
| 3,159,894 | 12/1964 | Haug | 63/14.5 X |
| 3,484,909 | 12/1969 | Sauer | 63/14.5 X |
| 4,059,971 | 11/1977 | Shoji | 63/29.2 X |

FOREIGN PATENT DOCUMENTS

| | | | |
|---|---|---|---|
| 210915 | 10/1957 | Australia | 63/14.5 |
| 1064284 | 5/1954 | France | 63/14.5 |
| 1191786 | 10/1959 | France | 63/29.2 |
| 2515939 | 5/1983 | France | 63/14.4 |

*Primary Examiner*—Laurie K. Cranmer

*Attorney, Agent, or Firm*—Malloy, Downey & Malloy

[57] ABSTRACT

A magnetized ear piece composed of a first and second pivotally interconnected member normally biased into a closed position and wherein one of the members is provided with magnet means to confront the ear lobe of a wearer and one of the members includes decorative means exteriorly visible when in use.

3 Claims, 1 Drawing Sheet

MAGNETIZED EAR PIECE

FIELD OF THE INVENTION

This invention relates to an ear piece and more particularly to what is known as an earring.

BACKGROUND OF THE INVENTION

In the past there have been numerous devices which have been utilized to clasp an earring to the ear lobe of a wearer. Conventionally, this has included a pair of pivotally interconnected members which are biased into a closed position so that, in use, the same bear against the ear lobe of a wearer.

SUMMARY OF THE INVENTION

This invention is of an improved ear piece of the type designed to clasp the ear lobe of a user. It includes a first and a second pivotally interconnected leg which are normally biased into a closed position when on the ear lobe of a wearer and wherein one of the members includes magnet means in confronting engagement with the ear lobe of a wearer and one of the legs includes a decorative outer surface which may include a holder means for a decorative stone or the like.

It is an object of this invention to provide a magnetized ear piece of the type described hereinafter which is simple and inexpensive to construct, well adapted for the purposes set forth and which securely grasps the ear lobe of a wearer utilizing biasing forces as well as a magnetizing force.

In accordance with these and other objects which will become apparent hereinafter, the instant invention will now be described with reference to the accompanying drawings in which:

DETAILED DESCRIPTION OF THE PREFERRED EMBODIMENT

Figure 1:
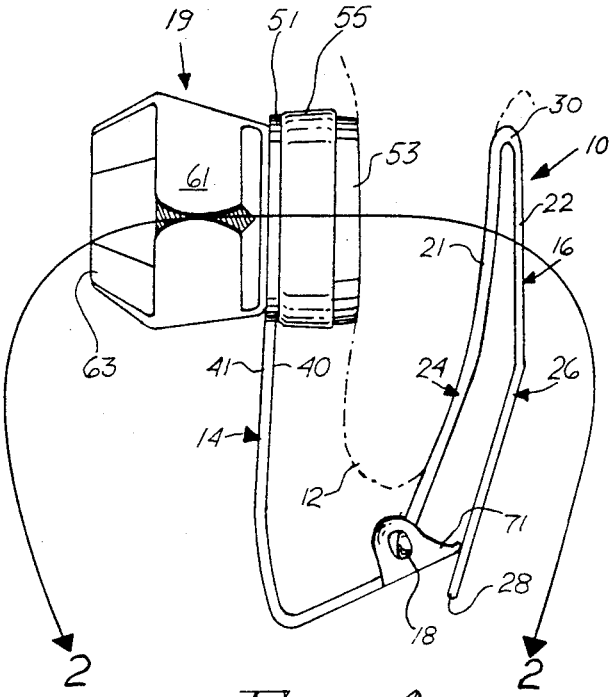
FIG. 1 is an enlarged side elevation view of the ear piece of the instant invention.
Figure 2:
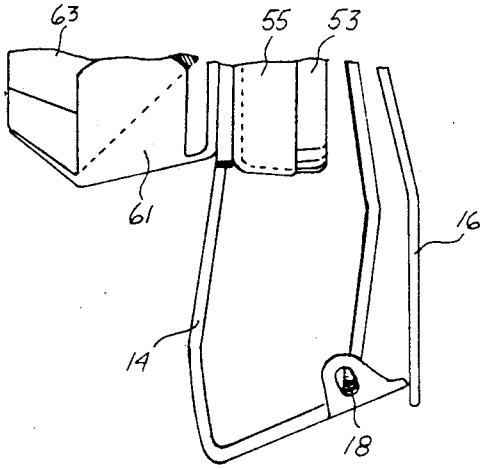
FIG. 2 is an enlarged partial view of the lower zone of FIG. 1 as indicated by the arrowed line 2—2 therearound.
Figure 3:
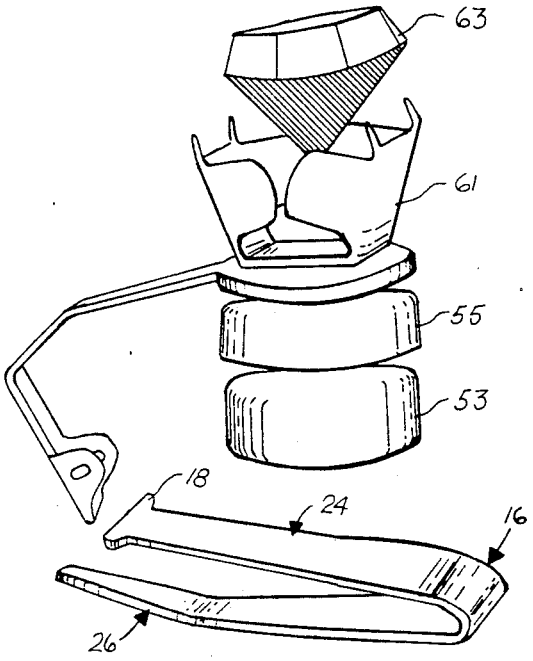
FIG. 3 is a view illustrating the inter-relationship of the component parts of the invention.
Figure 4:
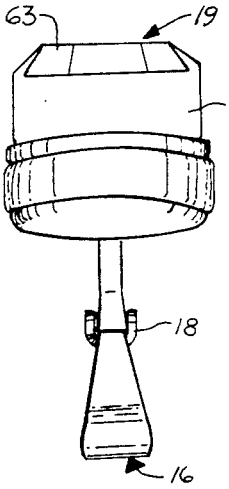
FIG. 4 is a top view of the ear piece shown in FIG. 1.

Referring to the drawings in which the ear piece is generally designated by the numeral 10 and shown secured to the lobe of an ear 12 shown in dotted lines. It is seen that there are a first and second member 14 and 16 which are pivotally connected together as at 18. On the first member 16 there is provided a decorative attachment designated by the numeral 19. Referring to the number 16 it is seen that it has an inside surface 21 and an outside surface 22 and that it is composed of a first leg 24 and a second leg 26 interconnected at a distal zone by a dog-turn bend zone 30, and that the leg 26 has a terminal end 28 which extends beyond the pivot means. The outer member 16 has an inside surface 40 and an outside surface 41. To the outer end 51 of the first member there is mounted, and extending from the inner surface, a magnet means 53 which may be captivated in an annular recessed structure 55, while from the outer surface 41 of the first member, there is the decorative means 18 composed of a gripping means 61 captivating a decorative stone 63. Preferably, toggle means now to be described are utilized to maintain the two members in an open position or a closed gripping position as shown in FIG. 1. This means may comprise the leg 26 at its lower end 28 being in engagement with a projection 71 so that at all times when in the position shown in FIG. 1, the projection 71 bears against the leg 26 tending to force it into the position shown in FIG. 1, yet yieldable upon pivotal movement of the second member relative to the first member, so that the projection is in a perpendicular relation to the leg 26 and then into a collapsed position near the end 28 for the earring to be in the open position.

It is thus seen that when the second member is pivotally moved with respect to the first member, the ear piece may be positioned over the lobe of a wearer and then moved into the gripping position shown in FIG. 1. In use, the magnet creates a small magnetic field about the ear lobe and this tends to secure the ear piece in position while the decorative piece 19 is displayed.

While this invention has been shown and described in what is considered to be a practical and preferred embodiment, it is recognized that departures may be made within the spirit and scope of this invention which should therefore not be limited except as set forth in the claims hereinafter within the doctrine of equivalents.

What is claimed is:

1. An ear piece comprising, an outer member having an inside surface and an outside surface, a one-piece inner member, pivot means hingedly interconnecting the members with said members normally extending in a common direction from the pivot means when worn by a wearer, said inner member comprising a first leg portion extending from the pivot means of predetermined length of an end zone and a second leg portion extending reversely from the end zone beyond the pivot means and closely adjacent thereto, said outer member having a projection of all times engaging the second leg portion and biasing the second leg portion away from the first leg portion and comprising a toggle means, said outer and inner members being aligned with one another at all times with the inner member being substantially behind the outer member, said outer member including magnet means on the inside surface for retaining decorative means on the outside surface, and said magnet means normally bearing against the first leg portion adjacent the end zone and being swingable to an open position with a space between the members.

2. The ear piece as set forth in claim 1 wherein said magnet means includes means to secure the same to the inside surface of the outer member.

3. The ear piece as set forth in claim 1 wherein said decorative means comprises holding means extending from the outside surface of the outer member and a decorative piece capitivated by said holding means.

* * * * *